US005561667A

United States Patent [19]

Gerlach

[11] Patent Number: 5,561,667

[45] Date of Patent: Oct. 1, 1996

[54] SYSTOLIC MULTIPLE CHANNEL BAND-PARTITIONED NOISE CANCELLER

[76] Inventor: Karl R. Gerlach, 6342 Meadowland Dr., Dunkirk, Md. 20754

[21] Appl. No.: 719,210

[22] Filed: Jun. 21, 1991

[51] Int. Cl.[6] ..... A04J 15/00

[52] U.S. Cl. ..... 370/32.1; 370/61; 342/373

[58] Field of Search ..... 370/32.1, 61, 58.1; 342/373, 201; 364/724.07

[56] References Cited

U.S. PATENT DOCUMENTS

| | | | |
|---|---|---|---|
| 4,588,255 | 5/1986 | Tur et al. | 364/728.03 |
| 4,596,986 | 6/1986 | Andrews et al. | 343/373 |
| 4,797,807 | 1/1989 | Gerlach | 364/724.07 |
| 5,047,784 | 9/1991 | Gerlach et al. | 342/201 |

OTHER PUBLICATIONS

Karl Gerlach, A Systolic, Multiple–Channel, Band–Partitioned Noise Canceller NRL Report 9225, Naval Research Lab. Jun. 14, 1990.

Karl Gerlach, A Numerically Efficient Band–Partitioned Noise Canceller NRL Report 9050, Naval Research Lab. Jun. 29, 1987.

Memorandum dated Apr. 18, 1991, from C. D. Moultree to "Code 3008.2" re NRL Report 9225, by Gerlach.

*Primary Examiner*—David C. Cain

[57] ABSTRACT

A novel band partitioned noise cancellation method and device is disclosed. In the invention, in which main and auxiliary channel data is transformed to the frequency domain by FFT's and then associated by frequency sub-bands. The noise is then cancelled using a sequence of operations including a commutating Gram-Schmidt canceller, an equivalent linear weight calculator, formation of a weight matrix, conversion of the weights to time domain by an inverse FFT and rotation of the weights. The weights are then combined with the main and auxiliary channel data in a transversal filter network to produce a noise-cancellation residue.

2 Claims, 12 Drawing Sheets

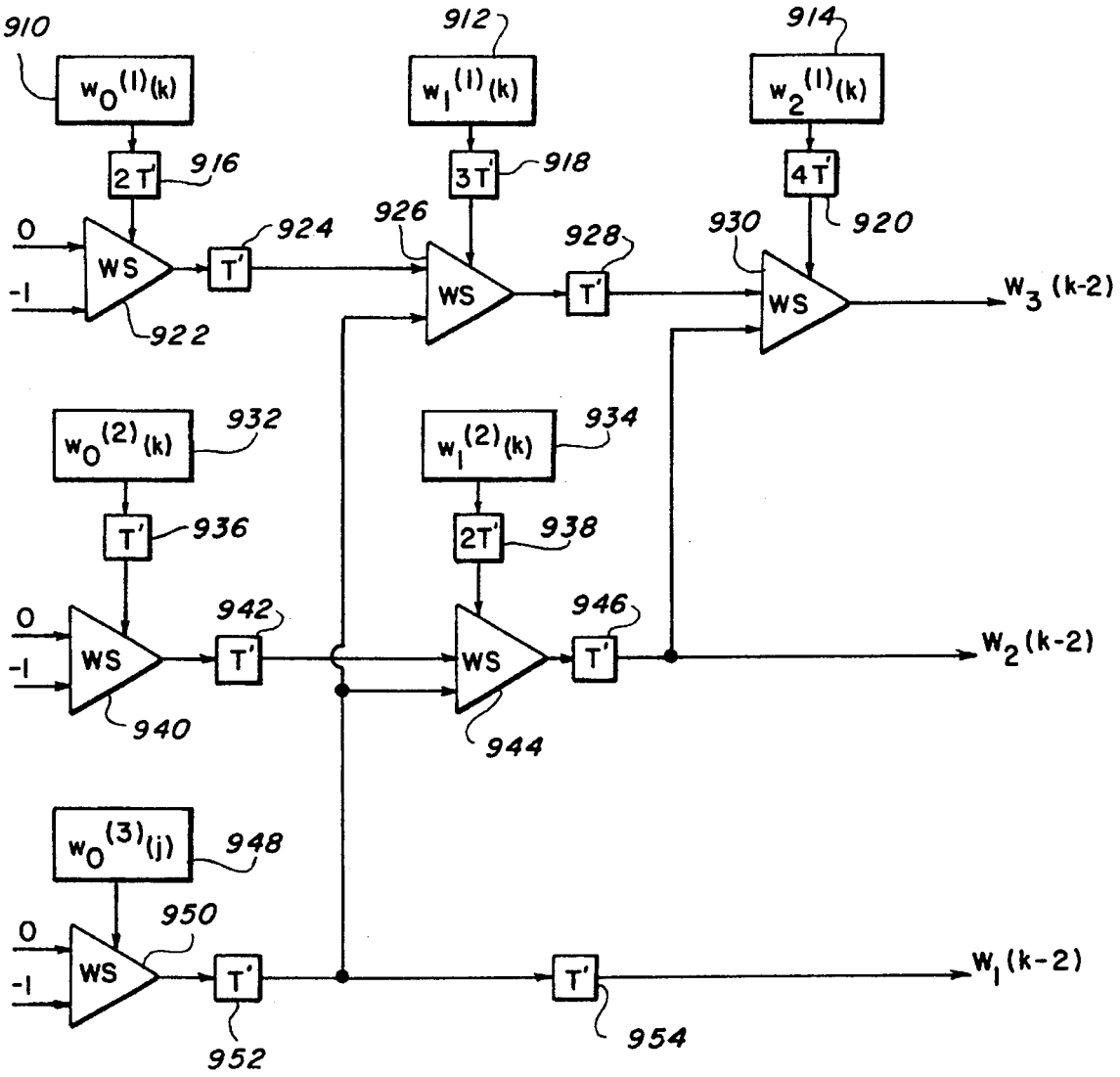
FIG. 12
FIG. 13
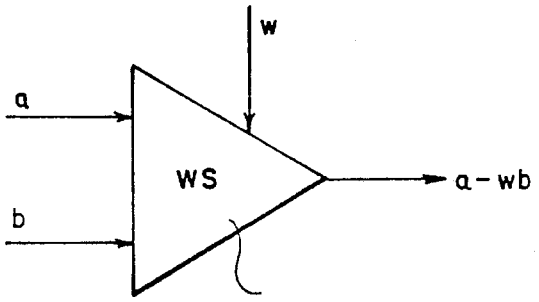

SYSTOLIC MULTIPLE CHANNEL BAND-PARTITIONED NOISE CANCELLER

FIELD OF THE INVENTION

This invention is related to the improvement of the detection of desired signals in the presence of interference which is efficient both numerically and in use of hardware.

DESCRIPTION OF THE PRIOR ART

Band-partitioned (BP) noise cancellation is a technique in which main and auxiliary channels are each identically filtered into a number of contiguous subbands; the associated subbands of the main and auxiliary channels are then cancelled; thereafter, the residues from each subband are summed to yield a final output residue. The subbands are assumed to cover the information bandwidth spectrum of the main channel. Typically, the desired information is assumed to be present only in the main channel. Corrupting additive noise is also in the main channel, and the auxiliary channel contains noise that is associated with this corrupting noise so that noise cancellation between the main and auxiliary channels is possible. The result of this noise cancellation process is that there will be less corrupting noise in the main channel. Hence, the signal-to-noise power ratio is enhanced.

The present inventor, in a paper entitled "A Numerically Efficient Band-Partitioned Noise Canceller," NRL Report 9050, Jun. 29, 1987, (hereinafter, "Gerlach"), discusses implementation of BP cancellation techniques. This report is incorporated herein by reference. Included is a discussion of the efforts of Lewis and Kretschmer who were the first to suggest an all-digital open loop implementation of the BP canceller. Their processor structure proved to be quite efficient numerically when compared to other open loop cancellation techniques known in the art such as the Sampled Matrix Inverse (SMI) method or the Gram-Schmidt canceller. However, a number of studies have indicated that the performance of the Lewis-Kretschmer BP canceller in terms of cancellation was in many cases significantly suboptimal to the other aforementioned techniques in terms of cancellation.

In the above-referenced paper, a transversal filter BP canceller was presented that is a derivative of the Lewis-Kretschmer processor. The key element in the transversal canceller is to use BP techniques to derive the canceller weights and then apply these weights using linear convolutional techniques. This technique significantly improves the cancellation performance of the BP canceller and maintains numerical efficiency.

The processing schemes that were discussed in Gerlach used what is commonly called "block processing," in which the adaptive weights are computed from the input blocks of data of the main and auxiliary channels. When new input blocks are presented to the BP canceller, a new set of adaptive weights is computed and these weights are applied to the same input blocks that were used to derive the weights.

SUMMARY OF THE INVENTION

The present invention overcomes the shortcomings of the prior art by providing a noise cancellation technique which in its implementation is both numerically efficient and hardware efficient and thus is a further improvement over the prior art. The present invention is directed to band partitioned noise cancellation in which main and auxiliary channel data is transformed to the frequency domain by FFT's and then associated by frequency subbands. The noise is then cancelled using a sequence of operations including a commutating Gram-Schmidt canceller, an equivalent linear weight calculator, formation of a weight matrix, conversion of the weights to time domain by an inverse FFT and rotation of the weights. The weights are then combined with the main and auxiliary channel data in a transversal filter network to produce a noise-cancellation residue.

The prior Lewis-Kretschmer canceller has the disadvantage that the cancellation ratio (CR) can vary significantly from sample-to-sample on a processed input data section with the center sample having the largest CR. Thus, non-homogeneous output noise samples are generated that can have a deleterious effect or impact on a Constant False Alarm Rate (CFAR) detector. The invention has the advantage of achieving the maximum canceller performance (the center sample CR) that can be attained by a BP canceller and generates homogeneous output noise samples, while at the same time being only modestly more complex with respect to hardware than the prior are BP canceller.

BRIEF DESCRIPTION OF THE DRAWINGS

FIG. 1(*b*) shows a plot of typical filter responses for a contiguous subbanding filter bank;

FIG. 10(*b*) shows a logic diagram of a basic two-input Gram-Schmidt canceller;

FIG. 12 shows a functional block diagram of an equivalent linear weight calculator (ELWC), L=4;

FIG. 13 shows a functional block diagram of a weighted subtractor; and

DETAILED DESCRIPTION OF INVENTION

Discussion of Theory and Noise Cancellation Elements

Figure 1A:
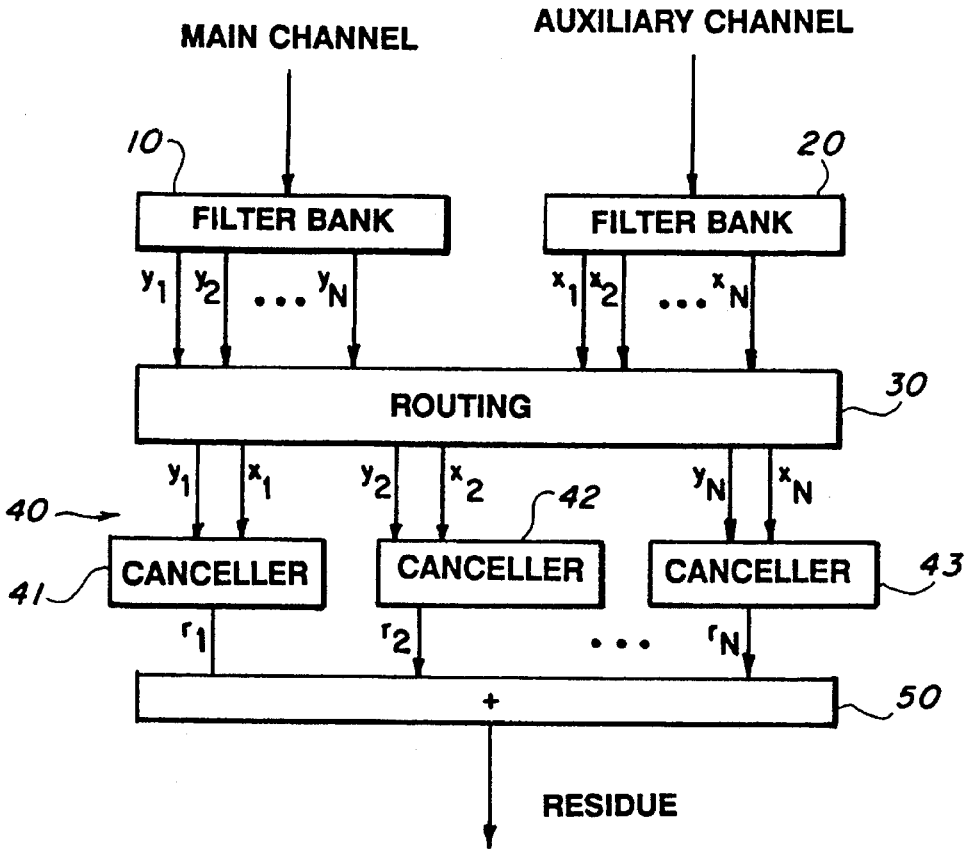
FIG. 1(*a*) illustrates a functional block diagram of a generic BP canceller for one auxiliary channel.
Figure 1B:
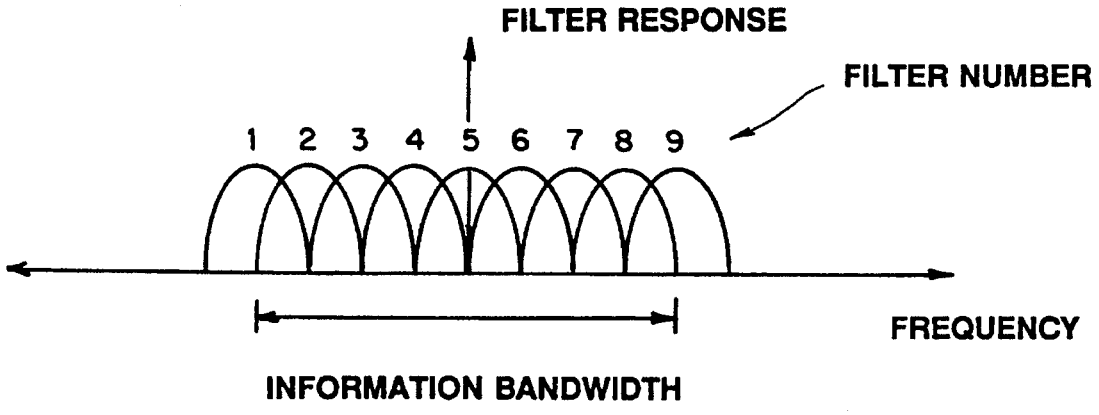

Referring now in detail to the drawings wherein like parts are designated by like reference numerals throughout, there is illustrated in FIG. 1*a* a generic band partitioned canceller for one main channel and one auxiliary channel. Multiple auxiliary channels are contemplated, however, as illustrated hereinafter. A data input stream from a main channel, such as a radar antenna or other target tracking signal acquisition device, is fed to a contiguous subbanding filter bank 10. Similarly, a data input stream from an auxiliary channel, such as an auxiliary radar antenna or other target tracking device, is fed to a contiguous subbanding filter bank 20. The invention may be used in any application having a main signal sensor and one or more auxiliary signal sensors. The data stream in the main channel and in the auxiliary channel each have an information bandwidth. FIG. 1*b* illustrates a typical filter response for a filter bank having N=9 filters, with the frequency plotted on the abscissa and the filter response plotted on the ordinate. Filter bank 10 yields $y_N$ values of main channel date, each corresponding to a specific subband frequency bandwidth for N filters, as shown in idealized form in FIG. 1*b*. Similarly, filter bank 20 yields $x_N$ values of auxiliary channel data, each corresponding to a specific subband frequency bandwidth for N filters. The $y_N$ and $x_N$ data streams are then associated according to frequency subbands in routing element 30. Such routing element 30 may be any routing network or other common frequency associating device as known in the art. Associated subband signals $y_l$, $x_l$ through $y_N$, $X_N$ are each fed to a BP canceller, designated generally as canceller 40, or a group of N cancellers 41, 42 and 42, as shown in FIG. 1*a*. The canceller 40 (or N cancellers) combine main and auxiliary inputs $y_l$, $x_l$, through $y_N$, $x_N$, respectively, to yield a group of N subband residues, designated $r_l$, through $r_N$. These residues are representative of subband signals with the corresponding noise cancelled therefrom. The residues are then summed in summing device 50, also as known in the art, to yield a single residue value corresponding to the information bandwidth. This single residue represents the target signal with the noise cancelled. The emphasis of this invention lies in the combined algorithmic and hardware implementation of a specific novel BP canceller, corresponding to canceller 40 of FIG. 1*a*. The present invention thus improves upon the known BP cancellers. The invention is implemented by digital hardware such as adders, multipliers, dividers, shift registers, buffers, clocks, Fast Fourier Transforms, Inverse Fast Fourier Transforms and others, as known in the art.

Before discussing the BP canceller of the present invention, the prior art BP cancellers are discussed to explain the underlying theory of cancellation and to distinguish the architecture, operation and implementation.

Figure 2:
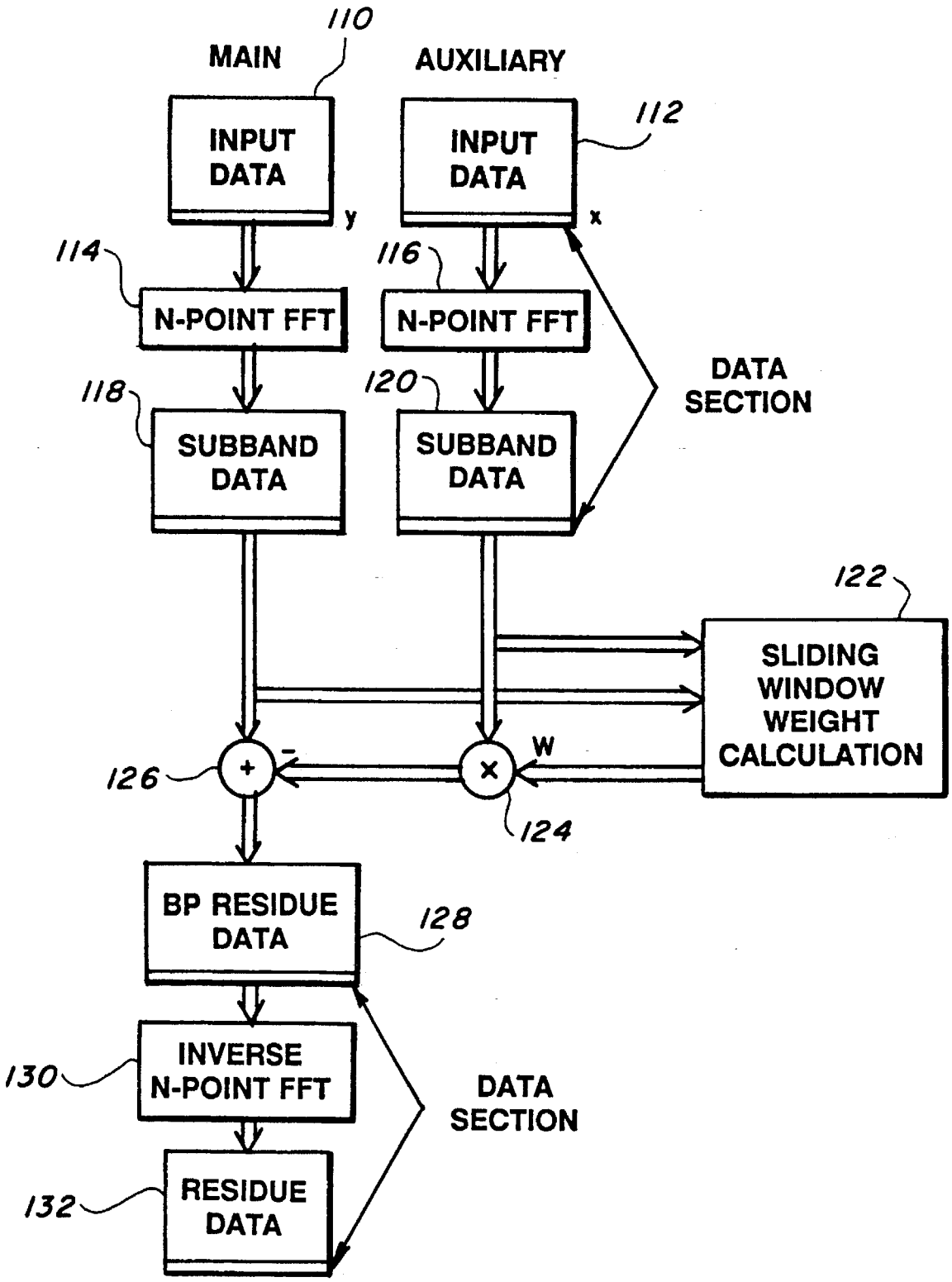
FIG. 2 shows a functional block diagram of a Lewis-Kretschmer BP canceller.
Figure 3:
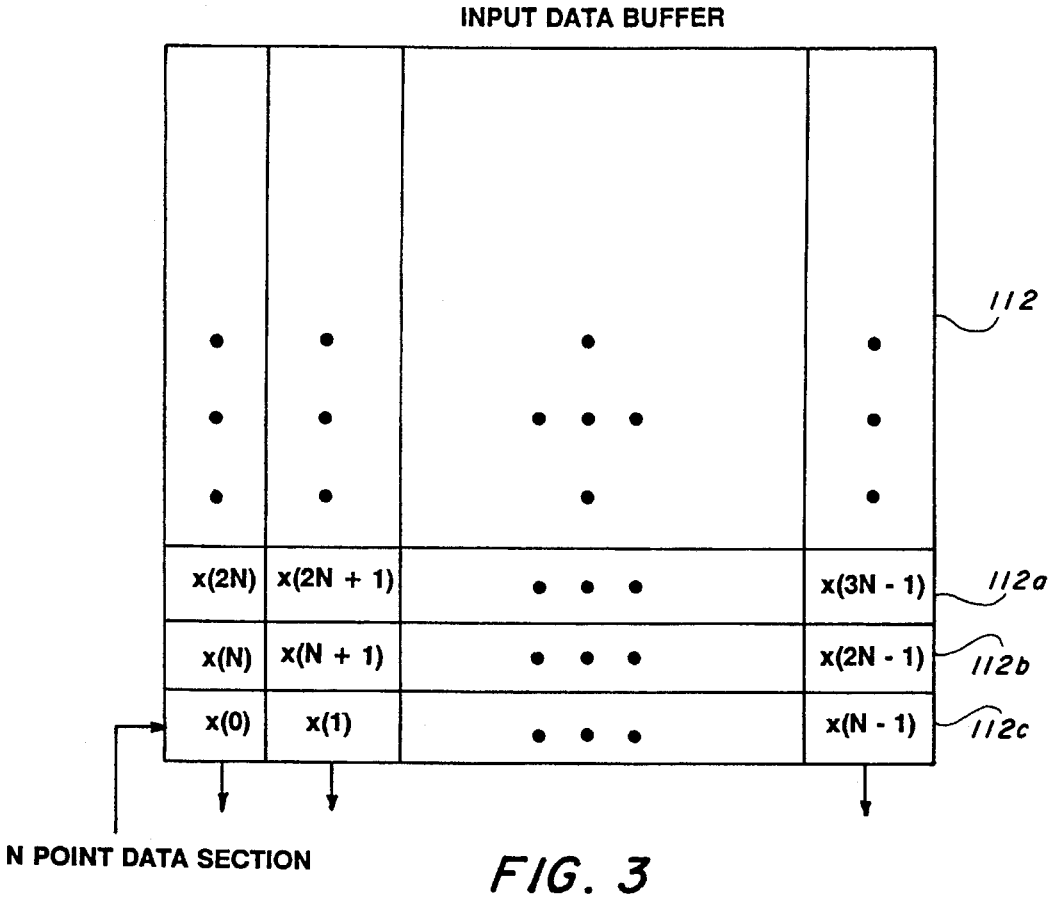
FIG. 3 illustrates an input data format array.

The Lewis-Kretschmer BP canceller for one auxiliary channel is illustrated in FIG. 2 and the associated data in a given channel is formatted as shown in FIG. 3. Such BP canceller corresponds generally to canceller element 40 in FIG. 1*a*. Data in the main and auxiliary channels is input to the BP canceller, as indicated respectively by input data blocks 110 and 112. N samples at a time (called N-point data sections) from each channel are Fast-Fourier transformed (FFT'ed) in N-point FFTs 114 and 116, respectively, to yield N subbands, for each channel, as represented by subband data blocks 118 and 120. An adaptive weight is computed "sliding window" fashion for each of the N-subbands from data that is in the particular subband, as indicated by block 122. The weight computation uses the current input sample of a particular band and the last K−1 samples in that band to compute the adaptive weight. The data that is used for this weight calculation is shown for illustrative purposes in FIG. 3. Data block 112 is comprised of individual sections of data, shown as 112*a*, 112*b* and 112*c*, with section 112*c* the N point data section. The current input sample is multiplied by this weight in multiplier element 124, after which this resultant is subtracted from the current input sample in the main channel, in summing element 126. Thus, there are N subband residues that result, as indicated in residue data block 128. These N residues are then inverse-fast Fourier transformed (hereinafter "IFFT'ed") in element 130, thereby converting the residues back into time domain residue samples, stored in residue data block 132. The canceller process is then repeated for new input sections of the main and auxiliary channels. Canceller processing is assumed to be in time beyond the transient time of the processor, i.e., enough samples have been processed so that there are no longer the initial "0's" in the processor.

Noise cancellation effectiveness can be determined and the results illustrated, as for example in FIG. 4, as follows:

$x = (x(kN), x(kN+1), \ldots, x((k+1)N-1))^T$, the *k'th* auxiliary input data section,
$y = (y(kN), y(kN+1), \ldots, y((k+1)N-1))^T$, the *k'th* main auxiliary input data section,
$r = (r(kN), r(kN+1), \ldots, r((k+1)N-1))^T$, the *k'th* output residue section, and $$W = \begin{bmatrix} W_1(k) & 0 & \ldots & 0 \\ 0 & W_2(k) & \ldots & 0 \\ \cdot & \cdot & \cdot & \cdot \\ \cdot & \cdot & \ldots & \cdot \\ \cdot & \cdot & \cdot & \cdot \\ 0 & 0 & \ldots & W_N(k) \end{bmatrix}, \tag{1}$$

where T denotes the transpose operation. It was shown in Gerlach that the k'th output residue section can be written as $$r = y - B^{-1}WBx \tag{2}$$

where $$B = (b_{mn}),\ m,\ n-1, 2, \ldots, N, \tag{3}$$

with $$b_{mn} = \frac{1}{\sqrt{N}}\ \Gamma_N^{(m-1)(n-1)}, \tag{4}$$

and $$\Gamma_N = e^{\frac{2\pi}{-jN}},\ j - \sqrt{-1}\ . \tag{5}$$

The matrix B is called the Butler matrix. Note that $B^{-1}=B^*$ where * denotes the complex conjugate. It can be shown that $B^{-1}W\,B$ has the following form:

$$\begin{bmatrix} w(1) & w(2) & w(3) & \ldots & w(N) \\ w(N) & w(1) & w(2) & \ldots & w(N-1) \\ w(N-1) & w(N) & w(1) & \ldots & w(N-2) \\ \cdot & \cdot & \cdot & \cdot & \cdot \\ \cdot & \cdot & \cdot & \ldots & \cdot \\ \cdot & \cdot & \cdot & \cdot & \cdot \\ w(2) & w(3) & w(4) & \ldots & w(1) \end{bmatrix}, \tag{6}$$

It is observed that each succeeding row of this matrix is a circular rotation of the preceding row.

Consider a single time-coincident data section of the main and auxiliary channels. Let x(1), x(2), . . . , x(N) and y(1), y(2), . . . , y(N) be the data points in each data section. Also, let r(1), r(2), . . . , r(N) be the output residues from these sections. From Eqs. (2) and (6), the residues can be written as $$r(1) = y(1) - w(1)x(1) - w(2)x(2) - w(3)x(3) - \ldots - w(N)x(N)$$
$$r(2) = y(2) - w(N)x(1) - w(1)x(2) - w(2)x(3) - \ldots -$$

-continued $$w(N-1)x(N)$$

$$\vdots$$

$$r(N) = y(N) - w(2)x(1) - w(3)x(2) - w(4)x(3) - \ldots - w(1)x(N) \quad (7)$$

Dillard, in a paper entitled "Band Partitioning for Coherent Sidelobe Cancellation," NOSC TD 597, May 1983, was the first to point out that a BP canceller is equivalent to cancellation in the time domain where the auxiliary time domain samples (in sections) are circularly convolved with a set of cancellation weights as is indicated by Eq. (7).

A limitation of the prior art Lewis-Kretschmer BP canceller is that the average output residue power of $|r(n)|^2$, n=1, 2, . . . , N is non-uniform. In fact, there can be a large difference in the cancellation performance on the end samples of a data section and the center sample of this section. (Note that if N is even, either the N/2 or N/2+1 samples is called the center sample.)

Figure 4:
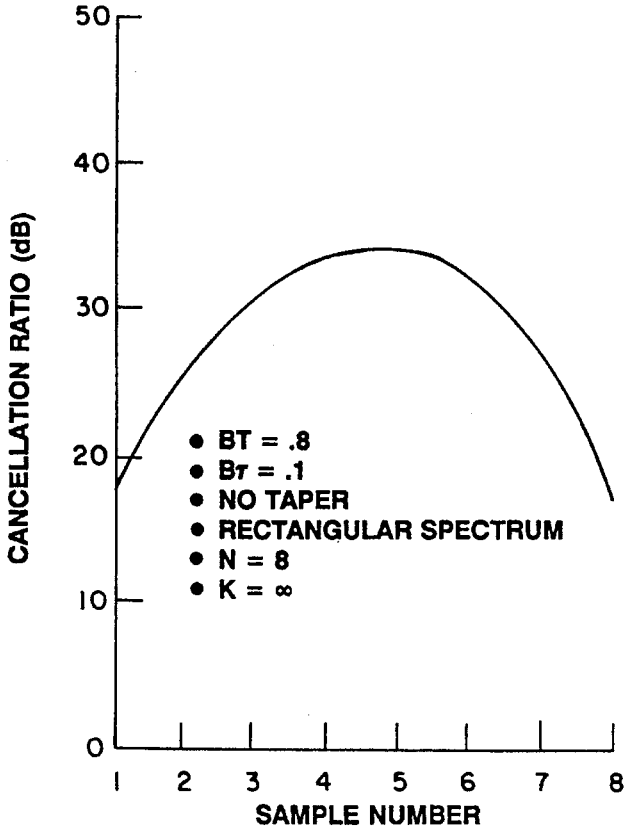
FIG. 4 shows a plot of cancellation ratio versus sample number.

FIG. 4 illustrates this point. FIG. 4 shows a plot of cancellation ratio (in decibels) versus sample number, in a given section. There is a multipath mismatch between the main and auxiliary channels of $B\tau=0.1$ where $B\tau$ is the bandwidth-multipath time delay product. For this example, N=8, the input data are untapered, the input spectrum is rectangular, the number of input samples K is infinite (steady state solution for the weights), and BT=0.8 where BT is the bandwidth-sampling time interval product. FIG. 4 shows the large difference ($\simeq$15 dB) between the cancellation performance for the center sample (n=4,5) and the end point samples (n=1,8).

Figure 5:
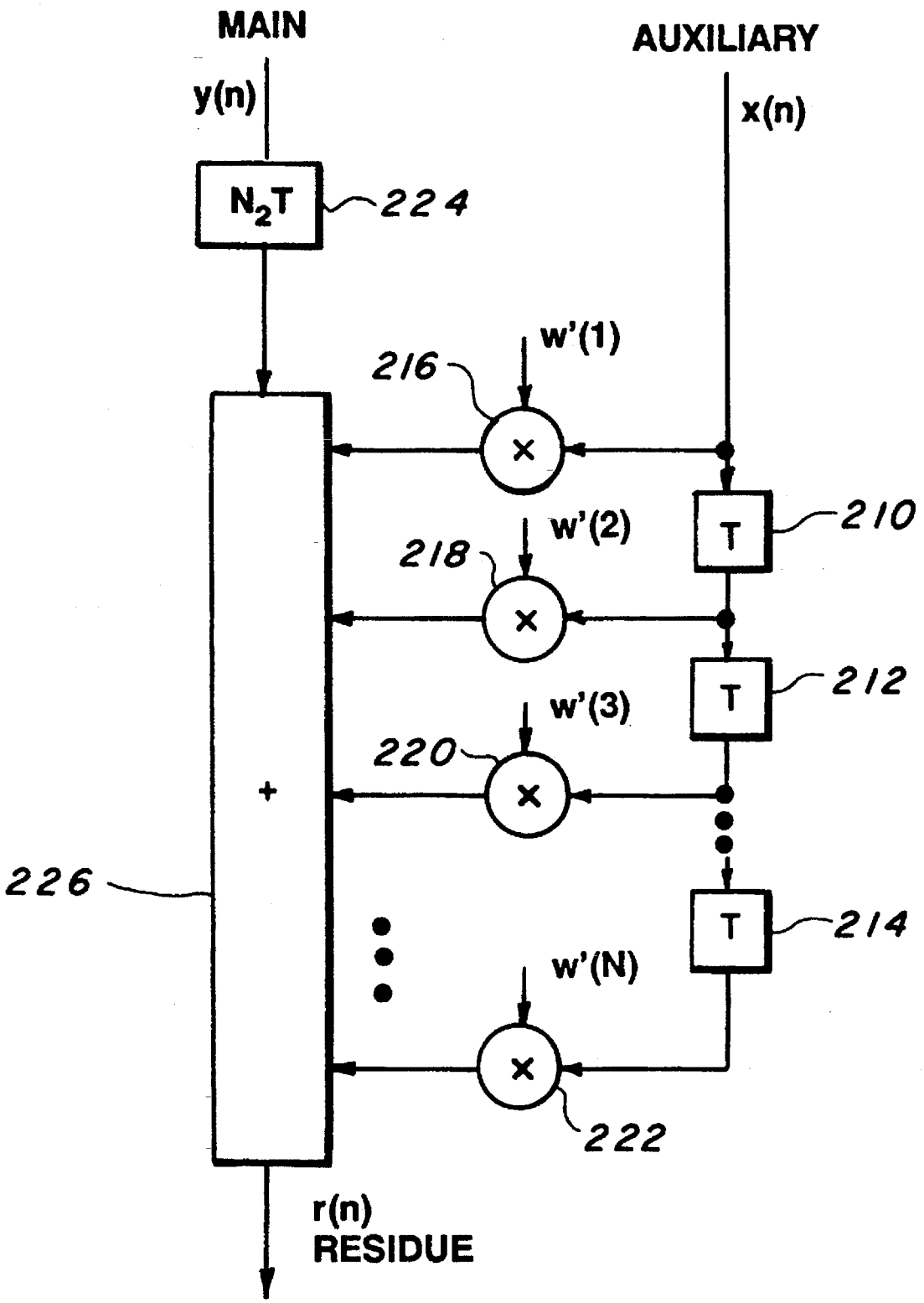
FIG. 5 shows a functional block diagram of a transversal filter implementation of a new BP canceller.

The prior art generic form of the BP canceller that was discussed in Gerlach is presented in FIG. 5. Simulation studies (deterministic and stochastic) have shown that the center sample of a data section for the Lewis-Kretschmer BP canceller tends to have the maximum cancellation ratio associated with it. This has been observed for both multipath and frequency mismatch errors between the main and auxiliary channels. From Eq. (5) the set of weights that is used to generate the center sample is $$w(w(N_2+1), w(N_2+2), \ldots, w(N), w(1), w(2), \ldots, w(N_2))^T \quad (8)$$

$$N_2 = \begin{cases} (N+1)/2 & \text{if } N \text{ is odd,} \\ N/2 & \text{if } N \text{ is even.} \end{cases} \quad (9)$$

From Eq. (7), note that the center sample of the main channel is time centered about the auxiliary time samples. Hence, the weight given by Eq. (8) could be applied to input data by a transversal filter implementation as shown in FIG. 5. In FIG. 5, auxiliary data x(n) is fed through a sequence of N transversal filters 210, 212 and 214. The value of x(n) is multiplied by the appropriated. weighting values by multipliers 216 to 222, as illustrated. These weighted auxiliary values are then summed in summing element 226 with main channel data which has been synchronized by $N_2T$ time delay 224. The resultant is a residue data stream r(n). As a consequence of this implementation, although the weights w are not the optimal transversal weights for minimizing the output residue, the average output residue would be the same as the center time sample of the Lewis-Kretschmer BP canceller. Thus, the output residue data stream r(0), r(1), . . . , is given by $$r(n) = y(n-N_2) - \sum_{m-1}^{N} w'(m)x(n-m), \quad (10)$$

where the weighting is defined as $$(w'(1), w'(2), \ldots, w'(N))^T = w. \quad (11)$$

Note that the w'(n) is matched with the rotated weights given by Eq. (8).

Figure 6:
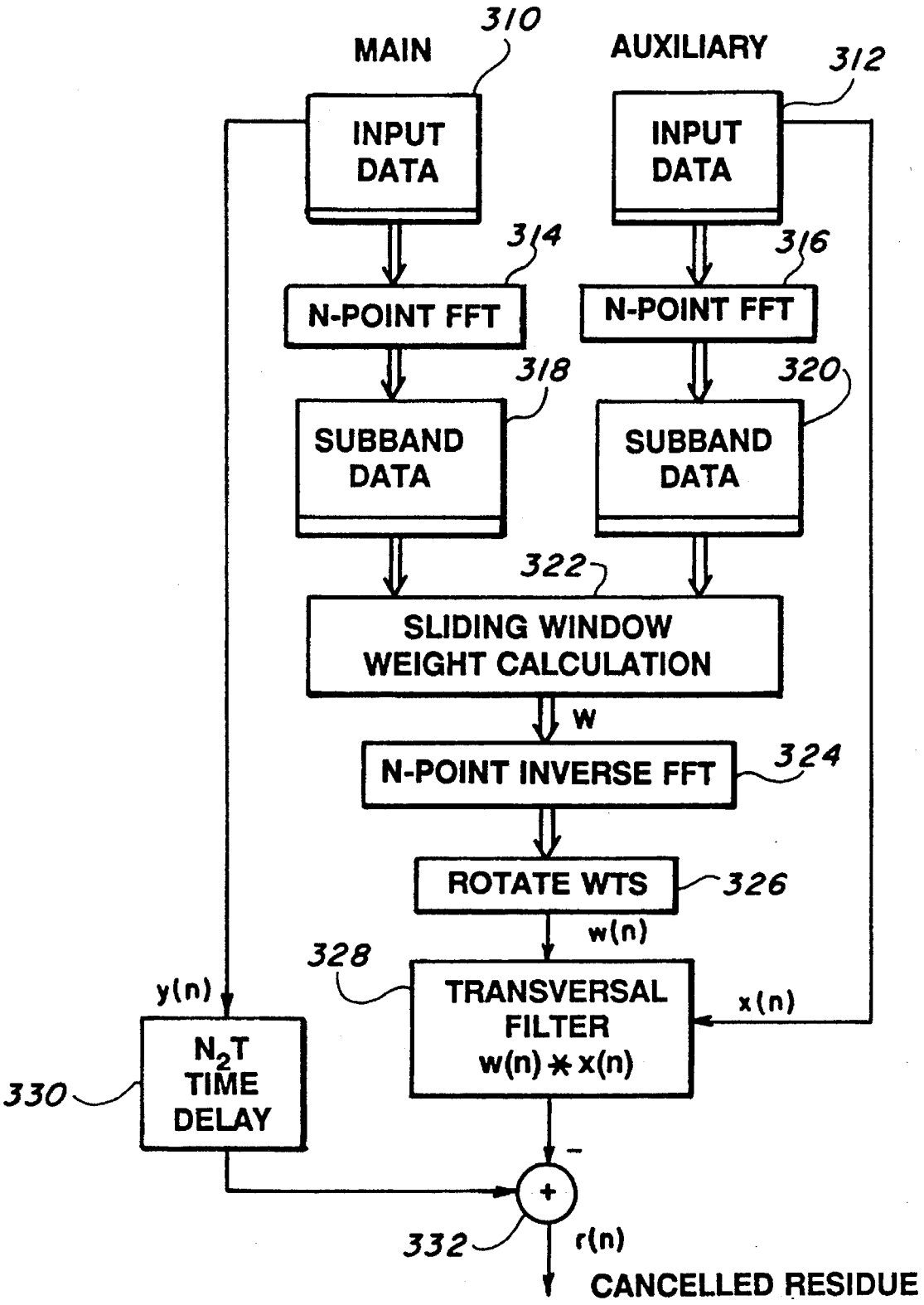
FIG. 6 shows a functional block diagram of a generic form of of the new BP canceller.

FIG. 6 shows a more detailed transversal filter BP canceller as discussed in Gerlach. In FIG. 6, main channel input data block 310 and auxiliary channel input data block 312 (each in a format as shown in FIG. 3) and respectively fed to N-point Fast-Fourier Transforms (FFT) 314 and 316. Such fast-Fourier Transformed data is respectively fed to main subband data block 318 and auxiliary to moving window weight calculation element 322. This weight calculation is then inverse-Fast Fourier Transformed in N-point inverse FFT 324 and the resultant time domain weights are then rotated in element 326. The resultant weights are then linearly convolved with input data in transversal filter 328. Main channel data is processed in an $N_2T$ time delay element 330. The time delayed main channel data and the weighted auxiliary data is summed in summing element 332, yielding a noise-cancelled residue. As seen, the weights w are derived in elements 322 to 328 by using similar front-end processing as the Lewis-Kretschmer BP canceller, i.e., $W_1$, $W_2$, . . . , $W_N$ are calculated from the subbanded data. We define the vectors $W_v$ and $w_v$ such that $$W_v=(W_1, W_2, \ldots, W_N)^T, \quad (12)$$

and $$w_v=(w_1, w_2, \ldots, w_N)^T, \quad (13)$$

From Eq. (6) it can be shown that $$w_v = \frac{1}{\sqrt{N}} B^* W_v. \quad (14)$$

Hence, $w_1, w_2, \ldots, w_N$ can be found by inverse-Fast Fourier Transforming $W_1, W_2, \ldots, W_N$. After $w_v$ is calculated, these weights are rotated yielding w.

These weights are then linearly convolved with the data stream of the auxiliary channel, and the resultant is subtracted from the main channel data stream, time-delayed by $N_2T$, yielding an output residue data stream:

$$r(n)=y(n-N_2)-w'(n) \otimes x(n),\ n=N, N+1, \ldots, (K-1)N-1 \quad (15)$$

where $\otimes$ indicates linear convolution.

Figure 7:
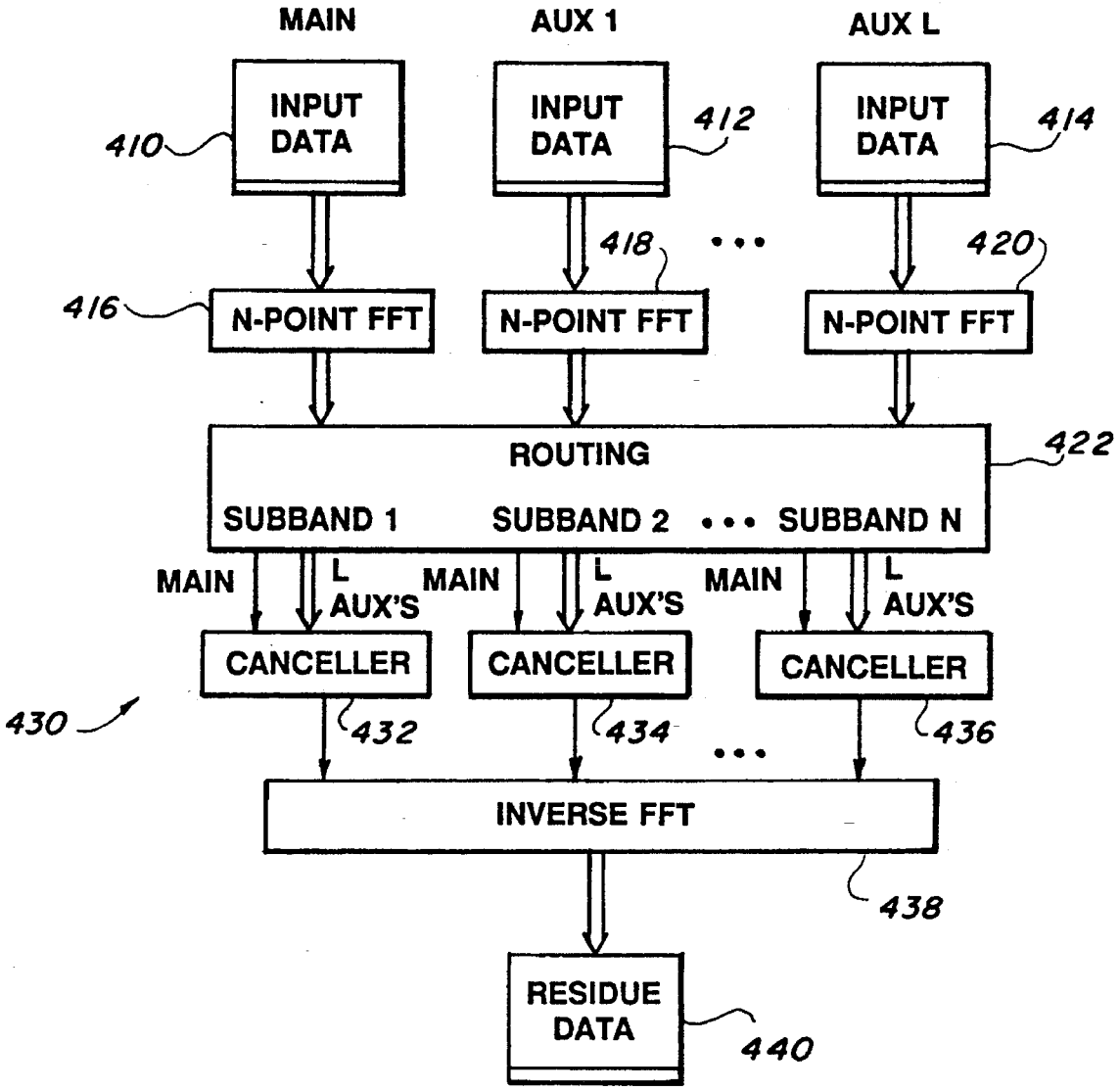
FIG. 7 shows a functional block diagram of a current BP canceller with multiple auxiliaries.

The transversal filter BP canceller can be extended to handle L auxiliary inputs where L>1. FIG. 7 illustrates the Lewis-Kretschmer BP canceller with multiple auxiliaries, substantially similar to FIG. 1*a*. FIG. 7 shows main input data block 410 and auxiliary data blocks 412 and 414, representative of L auxiliary channels. As in FIG. 1*a*, the input data is Fast Fourier transformed through N-point FFT's 416, 418 and 420. Routing element 422 associates the frequency subbands of the main and auxiliary channels. These associated frequency domain signals are then fed to BP cancellers 430, designated 432, 434, and 436. The resulting residues are fed to Inverse FFT element 438 with the resultant time domain residue data in block 440. The implementation is as follows: Sliding window processing is employed. After each N-length input data section is subbanded (or FFTed), the L+1 outputs for each subband are routed to an L+1-input canceller with the L auxiliaries in each subband cancelled against the main channel in that subband. The L-length vector of weights for each subband is assumed to be found by using the standard techniques (Sampled Matrix Inversion, Gram-Schmidt, etc.) Let the vector of weights for the nth canceller (or subband) be $$\tilde{W}_n=(W_{n1}(k), W_{n2}(k), \ldots, W_{nL}(k))^T. \quad (16)$$

L diagonal N×N matrices are formed as follows:

$$\overline{W}_l(k)=\begin{bmatrix} W_{11}(k) & 0 & \ldots & 0 \\ 0 & W_{12}(k) & \ldots & 0 \\ \cdot & \cdot & \cdot & \cdot \\ \cdot & \cdot & \ldots & \cdot \\ \cdot & \cdot & \cdot & \cdot \\ 0 & 0 & \ldots & W_{1N}(k) \end{bmatrix}, 1-1, 2, \ldots, L. \quad (17)$$

If y is the N-length vector associated with input data section, $X_1$, l=1, 2, . . . , L is N-length vector associated with the 1th auxiliary channel input data section, and r is the N-length vector associated with the residue data section, then it can be shown that $$r=y-\sum_{l=1}^{L} B^{-1}W_1B\cdot x_1 \quad (18)$$

Figure 8:
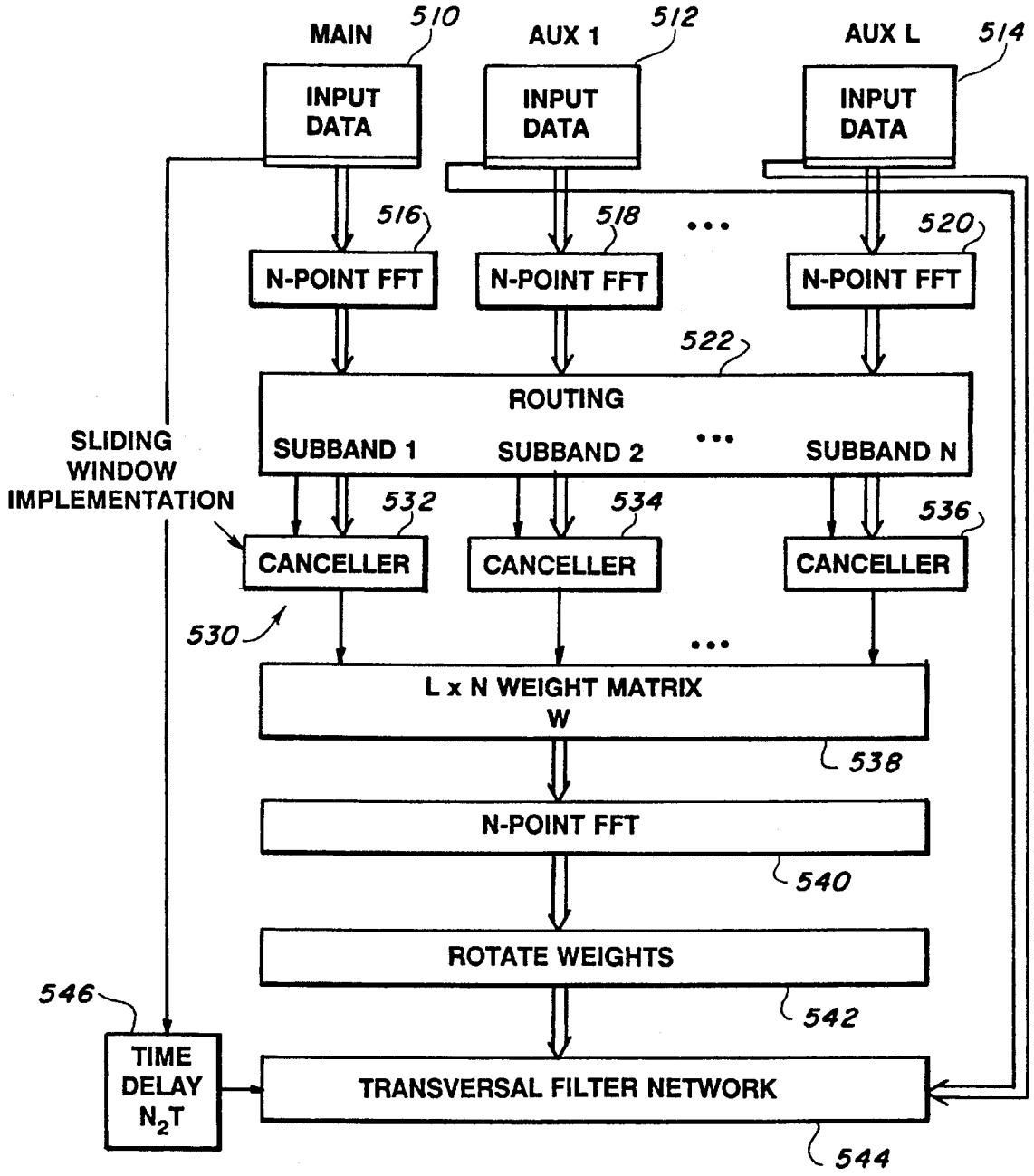
FIG. 8 shows a functional block diagram of a generic form of a multiple channel transversal filter band partitioned canceller.

Note that this form is identical to that used in Eq. (2) except for the summation. Hence, similar to the development in the previous discussion for the transversal filter BP canceller with one auxiliary, the residue formulation can be written as $$r(n)-y(n-N_2)-\sum_{l=1}^{L} w_1(n)\otimes x_1(n) \quad (19)$$

where $w_1(n)$ is the center row of the N×N matrix $B^{-1}W_1B$. Equation (19) exemplifies the processor form of the transversal filter BP canceller. A generic form of the multiple channel transversal filter BP canceller of Gerlach is shown in FIG. 8. The structure in FIG. 8 is essentially the same as that for the Lewis-Kretschmer BP canceller through the routing structure. Thus, elements 510, 512, 514, 516, 518, 520 and 522 function similarly to elements 410, 412, 414, 416, 420 and 422 (FIG. 7). However, after the NL adaptive weights are computed in the L cancellers 530, they are placed into an L by N buffer memory 538. Elements of this buffer memory are represented as an L×N matrix, W, defined as $$W=\begin{bmatrix} W_{11} & W_{12} & \ldots & W_{1N} \\ W_{12} & W_{22} & \ldots & W_{2N} \\ \cdot & \cdot & \cdot & \cdot \\ \cdot & \cdot & \ldots & \cdot \\ \cdot & \cdot & \cdot & \cdot \\ W_{L1} & W_{L2} & \ldots & W_{LN} \end{bmatrix}, \quad (20)$$

where the 1'th row of W is associated with the 1'th auxiliary channel. Each row is then IFFT'ed in N-point FFT 540 and rotated in element 542 as was done in Equation (8). This results in the following L×N matrix $$w=\begin{bmatrix} w_{11} & w_{12} & \ldots & w_{1N} \\ w_{12} & w_{22} & \ldots & w_{2N} \\ \cdot & \cdot & \cdot & \cdot \\ \cdot & \cdot & \ldots & \cdot \\ \cdot & \cdot & \cdot & \cdot \\ w_{L1} & w_{L2} & \ldots & w_{LN} \end{bmatrix}. \quad (21a)$$

Figure 9:
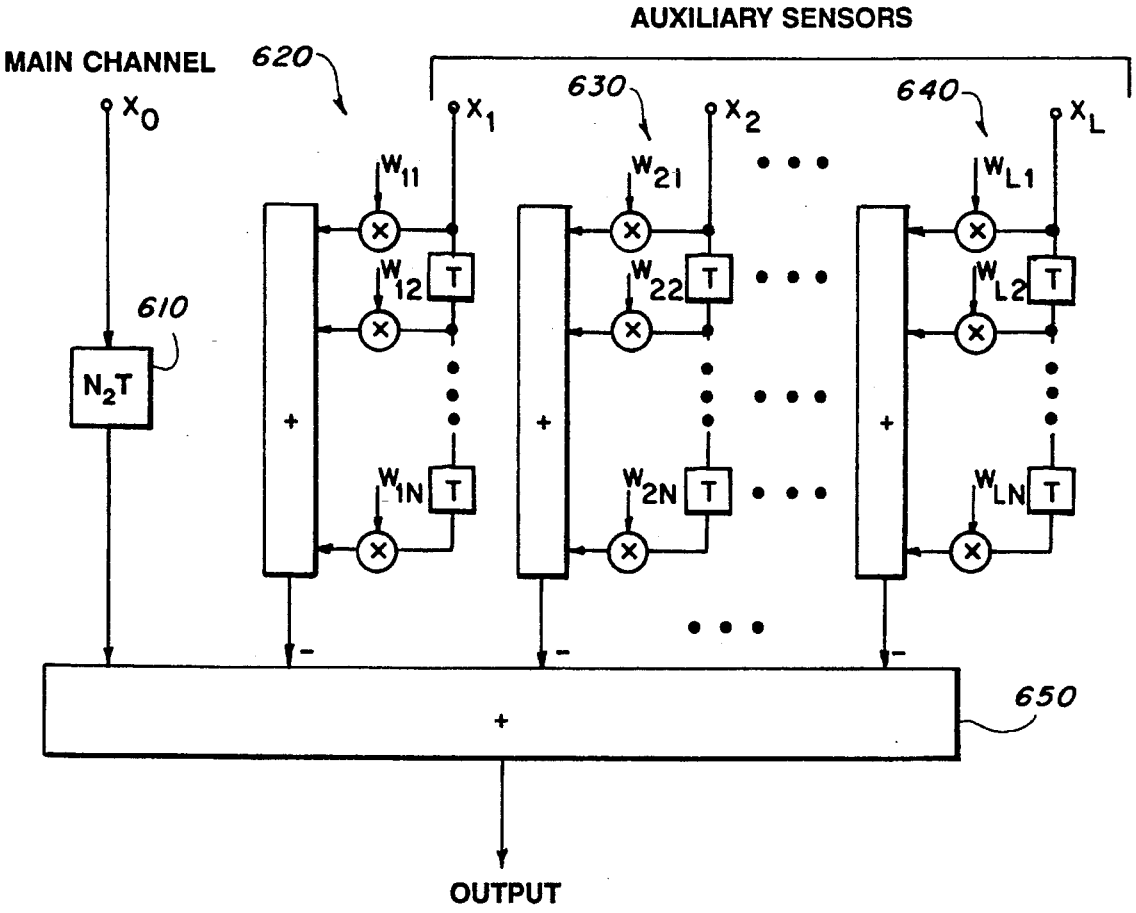
FIG. 9 shows a functional block transversal filter network.

The rows of w are then used as weights in the transversal filter network 544 illustrated in FIG. 9, using $N_2T$ time delay 546.

FIG. 9 shows a transversal filter network for multiple auxiliary sensors which is substantially similar to that shown and discussed for FIG. 5. $N_2T$ time delay 610 is the same as in FIG. 5. Multiple transversal filters 620, 630 and 640 are shown similar to those in FIG. 5. The resulting residues are summed in summing element 650 and corrected for time delay $N_2T$ to provide an output residue. Define $$w_l(k)=(w_{l1}(k), w_{l2}(k), \ldots, w_{lN}(k))^T, l=1, 2, \ldots, L \quad (21b)$$

to be the N-length weighting vector on the l channel for data section k. This process is repeated for new data sections in the main and auxiliary channels are input into the canceller. The weights of the transversal filter network are updated every N time steps or simply every NT seconds.

In the computation of the adaptive weights in the Lewis-Kretschmer BP canceller, tapering the input data sections can increase the cancellation ratio of the center output residue data sample. Hence, it may be desirable to taper the input data. Tapering of the input data can be simply incorporated into the multiple channel transversal filter BP canceller.

The weight applied linear convolution operation described previously can be made even more "optimal" by deriving it from tapered input data. Common tapers include Hanning, Hamming, and Blackman weighting.

$$\text{Let } a_1, a_2, \ldots, a_N \text{ denotes the taper with } a_{N_2}=1 \quad (21c)$$

Tapering the input data is equivalent to multiplying the input data blocks by an N×N diagonal matrix A defined by $$A=\begin{bmatrix} a_1 & 0 & \ldots & 0 \\ 0 & a_2 & \ldots & 0 \\ \cdot & \cdot & \cdot & \cdot \\ \cdot & \cdot & \ldots & \cdot \\ \cdot & \cdot & \cdot & \cdot \\ 0 & 0 & \ldots & a_N \end{bmatrix}, \quad (21d)$$

After cancellation, the input taper is removed by multiplying the output data block by $A^{-1}$. The BP canceller of Gerlach with tapered inputs is equivalent to $$r=y-A^{-1}B^{-1}W_MB\,Ax, \quad (21e)$$

where $W_M$ is derived from the tapered inputs in the main and auxiliary channels. From the N×N matrix, $A^{-1}\,B^{-1}W_M\,B\,A$, the weighting w for the center sample of each data section can be found. Note that $A^{-1}\,B^{-1}W_M\,B\,A$ does not have the form previously described, and thus the Gerlach derivative BP canceller with tapering is not equivalent to a circular convolution implementation in the time domain. If $w_1$, $w_2$, . . . , $w_N$ is the first row of the matrix $B^{-1}W_M\,B$, and N is even, then it can be shown that $$w=(a_1W_{N_2+1}, a_2W_{N_2+2}, \ldots, a_{N_2}W_N, a_{N_2+1}W_1, a_{N_2+2}W_2, \ldots, a_NW_{N_2})^T. \quad (21f)$$

From this equation it is seen that to form the suboptimal weights w, the rotated weights derived from $B^{-1}\,W_M\,B$ or equivalently the vector of weights $B^*\,W_v$ are tapered.

DISCUSSION OF INVENTION

The systolic implementation of the multiple channel transversal filter BP canceller of the present invention is a Gram-Schmidt canceller. The open-loop Gram-Schmidt (GS) technique for adaptive cancellation has been shown by those skilled in the art to yield superior performance simultaneously in arithmetic efficiency, stability, and convergence times over other adaptive algorithms. Arithmetic efficiency results from using systolic or sliding window processing architectures that take advantage of the GS structure. Also, the GS canceller algorithm is very suitable for a nonstationary noise environment because the adaptive weights can be updated in a numerically efficient manner, using "sliding window" techniques.

The method of the invention includes the steps of: storing main input data signals from said main signal channel in a storage buffer; storing input data from one or more auxiliary signal channels in one or more corresponding auxiliary input storage buffers, for storing signals; converting said signals from a time domain to a plurality of subbands in a frequency domain using a plurality of Fast Fourier Transform elements, each said Fast Fourier Transform element corresponding to a signal channel; associating said main channel frequency domain signals with said auxiliary channel frequency domain signals according to said frequency subbands; cancelling noise using successive combinations of weighted values of adjacent auxiliary channel subband data with associated main channel subband data, including a plurality of two-input Gram-Schmidt cancellers connected in cascade fashion; calculating equivalent linear weights; determining a weight matrix using said equivalent linear weights; converting said signals from a frequency domain to a time domain using a plurality of Inverse Fast Fourier Transform elements, each said Inverse Fast Fourier Transform elements corresponding to a signal channel; rotating weighted values of said weight matrix; and combining the resultant rotated weight values with time domain main channel and auxiliary channel data using a transversal filter network, thereby determining a main channel signal residue having noise cancellation.

Figure 10A:
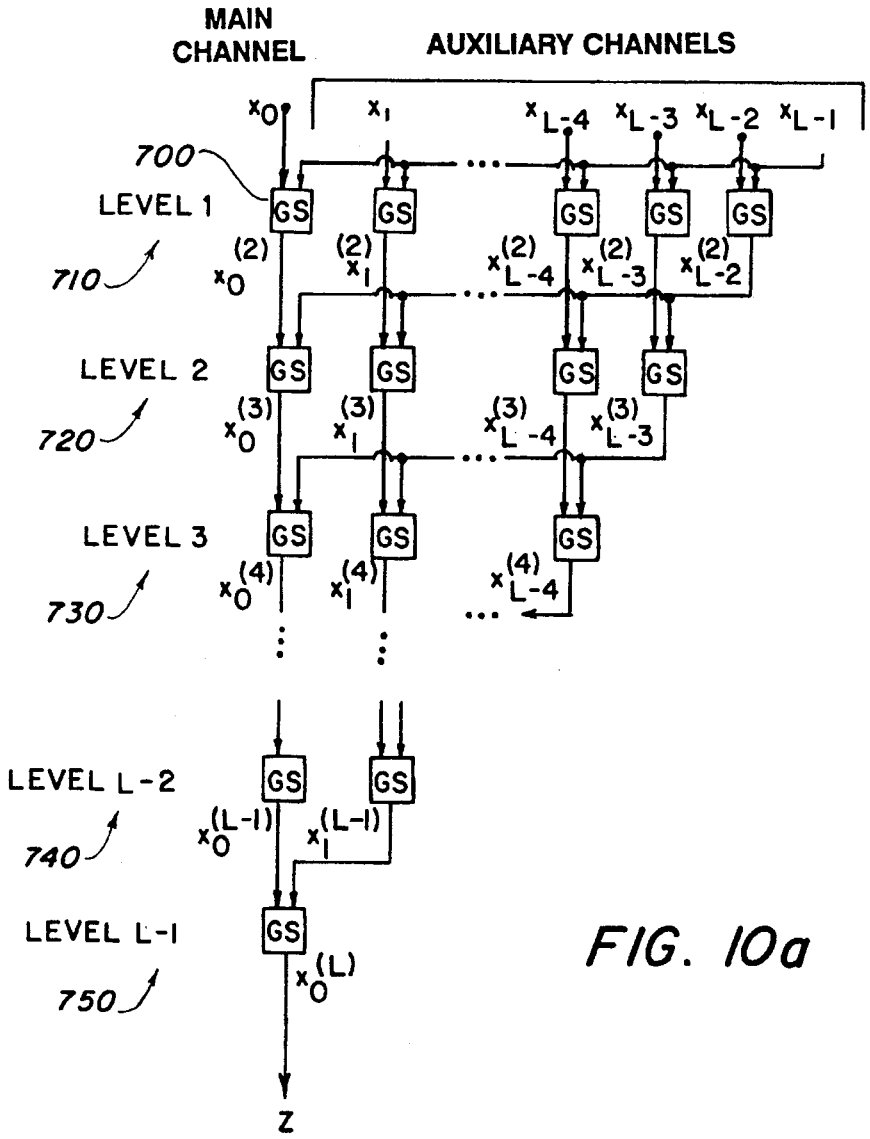
FIG. 10(*a*) shows a functional block diagram of a Gram-Schmidt structure.
Figure 10B:
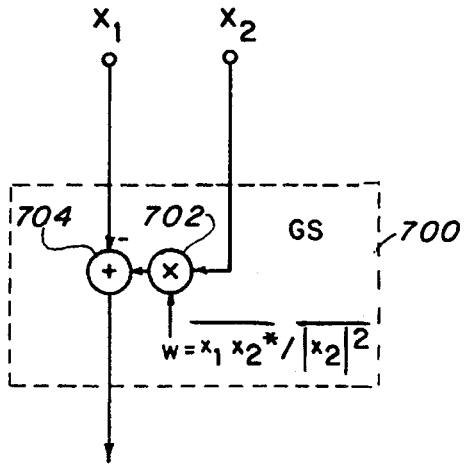

A general GS canceller structure is shown in FIG. 10*a*. L–1 levels of basic two-input GS cancellers are shown connected in cascade fashion. The GS structure is thus comprised of a plurality of GS cancellers, generally designated 700, arranged in L–1 levels, individually designated 710, 720, 730, 740 and 750. FIG. 10*b* shows the operative arrangement of each GS canceller 700. The second input (designated by auxiliary data $X_2$) is shown being fed to multiplier 702 which performs a weighting function on the auxiliary data. This weighted value is then subtracted from main data $X_1$, in summing element 704, to produce a residue value. Let $x_0$, $x_1$, $x_{L-1}$ represent the complex value data in the 0th, 1st . . . , L–1th channels, respectively. The leftmost input $x_0$ is the main channel, and the remaining L–1 inputs the auxiliary channels. As before, the signal of the main channel consists of a desired signal plus additive noise. This noise consists of internal noise plus external noise. Cancellation of the signals from external interfering sources relies on the correlation of simultaneously received signals in the main and auxiliary channels. The internal noises on each channel are assumed uncorrelated between channels. The canceller operates so as to decorrelate the auxiliary inputs one at a time from the other inputs by use of the basic two-input GS processor as is shown in FIG. 10(*b*). For example, FIG. 10*a* shows that $x_{L-1}$ is decorrelated with $x_0$, $x_1$, . . . , $x_{L-2}$ in the first level of decomposition. Next, the output channel that results from decorrelating $x_{L-1}$ with $x_{L-2}$ is decorrelated with the other outputs of the first-level GSs. The decomposition proceeds until a final output channel is generated. If the decorrelation weights in each of the two-input GSs are computed from an infinite number of input samples, this output channel is totally decorrelated with the input: $x_1, x_2, \ldots, x_{L-1}$. For a finite number of input samples, the decorrelation weights associated with each two-input GS canceller are estimated by using finite averaging.

The sliding window GS canceller processes the data on a sample-point-by-sample-point basis. For the sliding window GS canceller, the GS weights are estimated every time step (for the BP canceller, this is every NT seconds). Thus, the sliding window canceller tends to adapt to a nonstationary noise environment better than a block processor canceller does. The weights that are calculated in the GS structure are based on a fixed number of past samples from a given point in time. When the sampler steps one time interval, the newest sample is included in this estimate and the oldest sample is discarded.

The sliding window GS canceller is described mathematically as follows. For any indexed time instant k, set $$X_1(k)=[x_1(k), x_1(k-1), \ldots x_1(k-K+1)]^T,\ 1=0, 1, 2, \ldots, L-1 \quad (22)$$

where K is the number of samples used to calculate each of the GS weights. From FIG. 10(*a*), the input vectors into the mth level of the GS structure are defined as $$X_1^{(m)}(k)=[x_1^{(m)}(k), x_1^{(m)}(k-1), \ldots, x_1^{(m)}(k-K+1)]^T, \quad (23)$$

where $X_1^{(1)}(k)=X_1(k)$ and $x_1^{(1)}(k)=x_1(k)$. The outputs of the two-input GSs at the (m+1) level are given by $$x_l^{(m+1)}(k+1) = x_l^{(m)}(k) - w_l^{(m)}(k)\, x_{L-m}^{(m)}(k), \quad (24)$$

$$l = 0,1, \ldots, L-m-1$$
$$m = 1, 2, \ldots L-1$$

where $$x_l^{(m+1)}(k+1) = x_l^{(m)}(k) - w_l^{(m)}(k) x_{L-m}^{(m)}(k), \quad (25)$$

and t denotes the conjugate vector transpose operation. $w_1^{(m)}(k)$ is an interior weight of the GS.

One difficulty of using a GS canceller as the "canceller" for the transversal filter BP canceller is that the GS weights are not the same weights as those used for the transversal filter BP canceller. However, the BP weights can be derived from the GS weights as shown below. In addition, a systolic method of deriving these weights which is very similar to the GS structure is presented.

Figure 11:
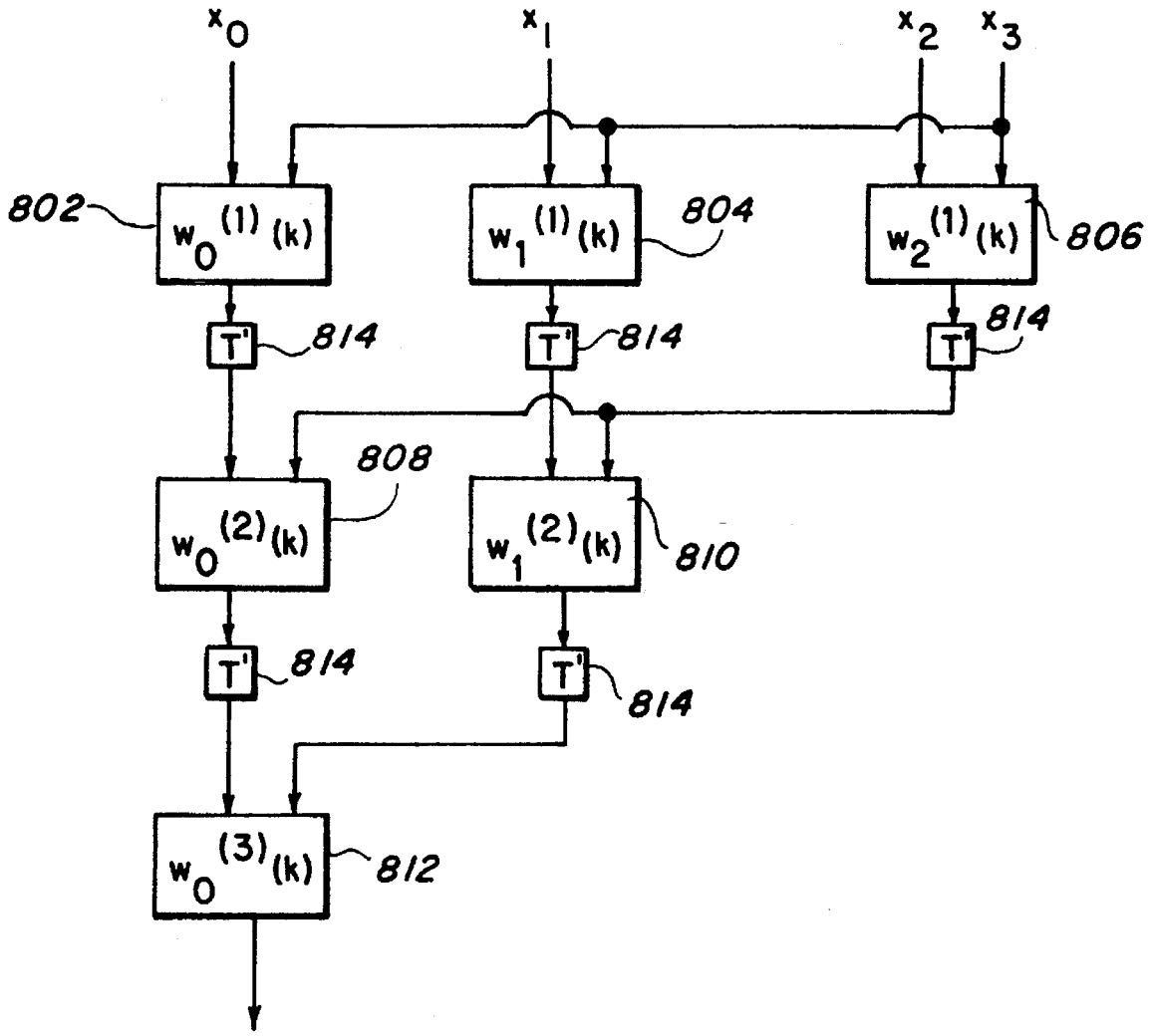
FIG. 11 shows a functional block diagram of a Gram-Schmidt with weights only, L=4.

The GS processor is redrawn in FIG. 11 with just the calculated weights (blocks 802, 804, 806, 808, 810 and 812) displayed for L=4 (note the discussion which follows generalizes for any L). The time delay, T', shown in this figure (blocks 814) is the step time associated with calculating the weights in systolic or sliding window fashion (T'=NT). Let $w_1^{(m)}$ represent the steady value of $w_1^{(m)}(k)$. An infinite number of samples per channel, K, were used to compute the weight, and hence the weight is at its optimal value. It can be shown that for any set of GS interior weights that there is an equivalent linear weighting of the input channels. Thus, the outputs of the GS processed main channel are identical to the outputs of a main channel derived by subtracting the linear weighted auxiliary channels from the main channel input. The main channel output can be written $$z=x_0-W_1x_1-W_2x_2 \ldots -W_{L-1}x_{L-1} \quad (26)$$

where $W_1, W_2, \ldots, W_{L-1}$ are the weights of the equivalent linear weighting. (Note the discussion in this section is generic in nature and that weights may share the same symbols as the weights in the previous sections.)

In terms of the GS interior weights it can be shown that the equivalent linear weights can be found through the following set of equations as $$\begin{aligned} W_1 &= w_0^{(L-1)} \\ W_2 &= w_0^{(L-2)} - w_1^{(L-2)}W_1 \\ W_3 &= w_0^{(L-3)} - w_1^{(L-3)}W_1 + w_2^{(L-3)}W_2 \\ &\vdots \\ W_{L-1} &= w_0^{(1)} - w_1^{(1)}W_1 + w_2^{(1)}W_2 - \ldots (-1)^{(L-2)}w_{L-2}^{(1)}W_{L-2} \end{aligned} \tag{27}$$

For finite sampling, there exists an equivalent linear estimated weighting which can be derived from the estimated GS interior weights. However, due to the sliding window processing the GS interior weights are not time aligned estimates. In fact, the weights, at a successive level of the GS structure are one time step behind the weights at a given level. Thus, in order to compute the equivalent linear weights at a given instant of time, it is necessary to use time delayed estimates of the interior weights. Thus, the weights are written as $$\begin{aligned} W_1(k) &= w_0^{(L-1)}(k) \\ W_2(k) &= w_0^{(L-2)}(k-1) - w_1^{(L-2)}(k-1)W_1(k) \\ W_3(k) &= w_0^{(L-3)}(k-2) - w_1^{(L-3)}(k-2)W_1(k) + \\ &\quad w_2^{(L-2)}(k-2)W_2(k) \\ &\vdots \\ W_{L-1}(k) &= w_0^{(1)}(k-L+2) - w_1^{(1)}(k-L+2)W_1(k) \ldots \\ &\quad (-1)^{(L-2)}w_{L-2}^{(1)}(k-L+2)W_{L-2}(k). \end{aligned} \tag{28}$$

A functional block diagram of a systolic implementation of an Equivalent Linear Weight Calculation (ELWC) is shown in FIG. 12 for L=4. Similar to the GS processor, it works on a clocked basis where data is calculated and transferred at the clock rate denoted by T'. The ELWC is an arrangement of weight data blocks 910, 912, 914, 932, 934 and 948, time delay elements 916, 918, 920, 936, 938, 952 and 954 and weighted substractors 922, 926, 930, 940, 944 and 950 which are arranged in cascade fashion to produce weight values. The ELWC essentially implements the equations for the equivalent linear weights given by Eq. (28). The weighted subtractor is illustrated in FIG. 13. The bottom left input to the weighted subtractor, WS box, b, is weighted by w and subtracted from the top left input a. The GS interior weights at time instant kT' are inputted into the ELWC. These inputs, $w_1^{(m)}(k)$, are appropriately time delayed by $\tau_1^{(m)}$ for a particular m and 1 which index the interior GS weight. In general $$\tau_1^{(m)}=(L-1-m+1)T' \tag{29}$$

If desired, the ELWC could use the same multipliers and subtractors as the Gram-Schmidt processor. This results because the weighted subtractor, WS, used in the ELWC is functionally equivalent to a portion of the 2-input GS processor element seen in FIG. 10(*b*) in that the 2-input GS processor also weights and subtracts one input from another input. Hence, no additional hardware other than some storage elements are necessary to implement the ELWC. Only storage elements need be used to implement the time delays of the ELWC.

In addition for the ELWC, the first column of WS's (922, 940 and 950) as shown in FIG. 12 can be deleted by directly connecting the output of the $\tau_1^{(m)}$ delay to the T' delay. This is because the inputs to each WS are 0 and −1, so that the output is merely the inputted weight at a given WS.

Figure 14:
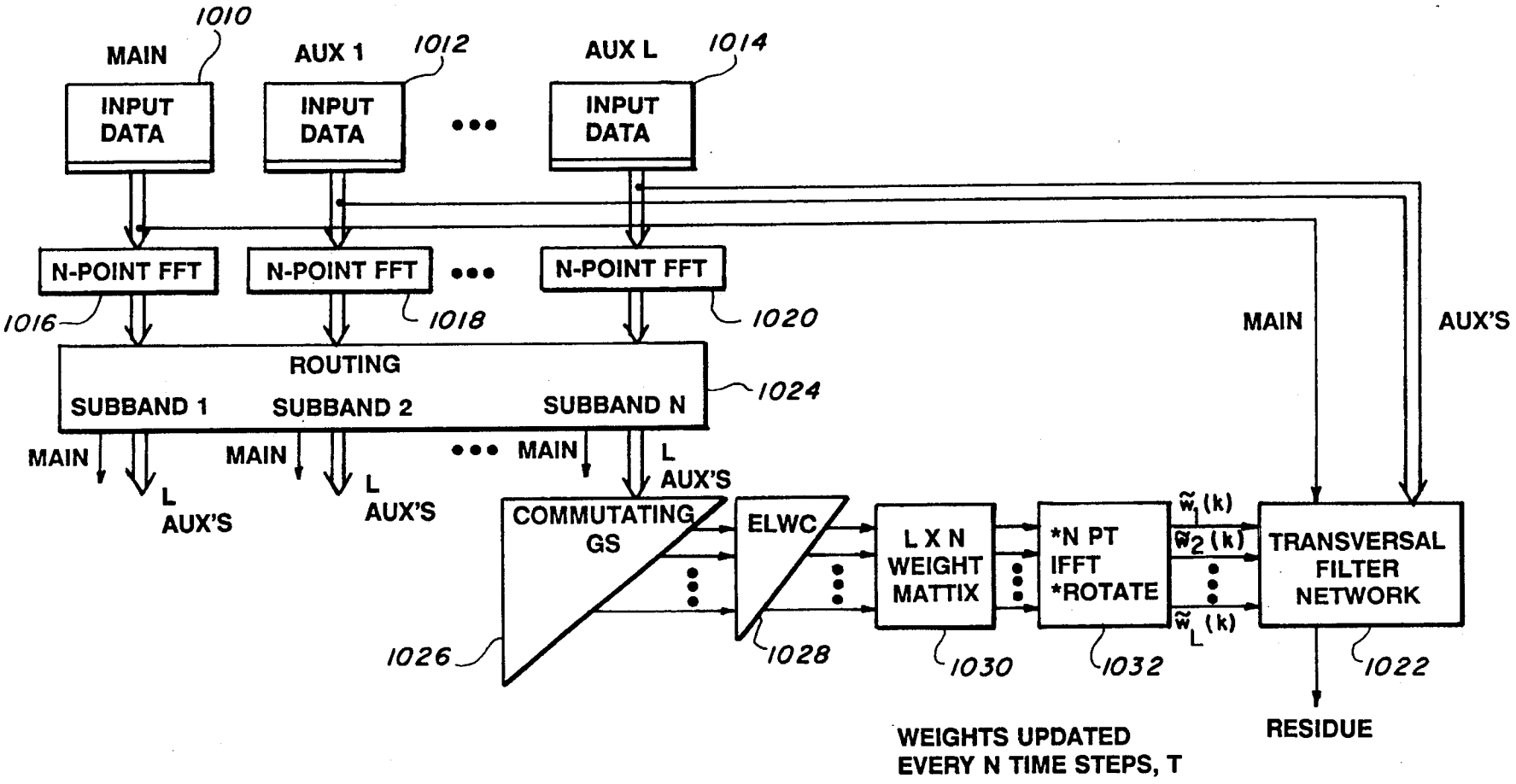
FIG. 14 shows a functional block diagram of a systolic multiple channel band partitioned weight calculator.

The generic form of the multiple channel band partitioned canceller (MCBPC) was described above and illustrated in FIG. 7. A systolic implementation of the MCBPC of the present invention is shown in FIG. 14. The structure of the MCBPC is similar to that in FIG. 7 through the routing of subbanded signals. Input data block 1010 for the main channel and input data blocks 1012 and 1014 for the auxiliary channels feed N-point FFT's 1016, 1018 and 1020, as before. In addition, main channel data and auxiliary channel data are fed to transversal filter network 1022. FFT'ed data, in the frequency domain is routed and associated by subbands in routing element 1024. The associated main and auxiliary channel data is then fed to a commutating GS canceller 1026. The data processed by the GS canceller is then fed to the ELWC, a L×N weight matrix is prepared in block 1030, the weight matrix is IFFT'ed and then rotated in block 1032 and the resulting weights are fed to the transversal filter network 1022. Then the data and weights are combined to produce a noise-cancelled residue.

The difference between the generic form and the form shown in this figure is that the canceller is implemented using a GS canceller and the GS weights are converted to an equivalent linear set of weights by the Equivalent Linear Weight Calculator (ELWC) processor. In addition, because the subband samples are updated every NT seconds, the N cancellers shown in the generic configuration of FIG. 8 are operating at a processing bandwidth of 1/NT. Hence, these N cancellers could be replaced by one canceller (as suggested by Lewis-Kretschmer) operating at a processing bandwidth of 1/T as illustrated by the commutating GS canceller seen in FIG. 14. This one canceller calculates all of the interior GS weights for each subband within NT seconds. The GS canceller processes successive subband channels starting from the first to last subband channel. At the same time the ELWC converts these GS weights into their linear equivalents which are stored in the L×N weight matrix. At the end of the GS canceller sweep through the N subbands, the L×N matrix is filled. Thereafter each row of this matrix is IFFT'ed, rotated, and applied to the transversal filter network (illustrated in FIG. 9). This process is repeated for each new N-point input main and auxiliary data seconds. The transversal filter network weight are updated every NT seconds. The N points that are in each of the main and auxiliary channels are processed through the transversal filter network after the weights have been updated in order to maintain synchronization. Thus, the transversal filter weights are updated using the current input data section and these weights are applied back onto this section. As a result, cancellation will not be seriously degraded if there is a moderate amount of nonstationarity in the input data.

The new implementation described above is a novel derivative of the Lewis-Kretschmer BP canceller. The invention achieves the maximum canceller performance that can be attained by a BP canceller while at the same time being only modestly more complex with respect to hardware then the Lewis-Kretschmer BP canceller. Both take advantage of systolic implementations to increase data throughput.

An alternative embodiment of the invention is that the transversal filters could be implemented using fast convolutional techniques of Gerlach. In fact, it was shown in Gerlach that much of BP weight computation hardware can be shared by the fast convolution processors. This is because the fast convolutional technique is implemented using FFT's. If fast convolutional techniques are employed, an "overlay and save" method as known in the art would be most appropriate for this application.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What I claim is:

1. A device for cancelling noise from a main signal channel comprising:

a main input data storage buffer for storing signals from said main signal channel;

one or more auxiliary input storage buffers, corresponding to one or more auxiliary signal channels, for storing signals;

a plurality of Fast Fourier Transform elements, each said Fast Fourier Transform element corresponding to a signal channel, said Fast Fourier Transform elements converting said signals from a time domain to a plurality of subbands in a frequency domain;

means for associating said main channel frequency domain signals with said auxiliary channel frequency domain signals according to said frequency subbands;

means for cancelling noise using successive combinations of weighted values of adjacent auxiliary channel subband data with associated main channel subband data, including a plurality of two-input Gram-Schmidt cancellers connected in cascade fashion;

an equivalent linear weight calculator;

means for determining a weight matrix;

a plurality of Inverse Fast Fourier Transform elements, each said Inverse Fast Fourier Transform elements corresponding to a signal channel, said Inverse Fast Fourier Transform elements converting said signals from a frequency domain to a time domain;

means for rotating weighted values of said weight matrix; and a tranversal filter network operating to combine the resultant rotated weight values with time domain main channel and auxiliary channel data, thereby determining a main channel signal residue having noise cancellation.

2. A method of cancelling noise from a main signal channel comprising the steps of:

storing main input data signals from said main signal channel in a storage buffer;

storing input data from one or more auxiliary signal channels one or more corresponding auxiliary input storage buffers for storing signals;

converting said signals from a time domain to a plurality of subbands in a frequency domain using a plurality of Fast Fourier Transform elements, each said Fast Fourier Transform element corresponding to a signal channel;

associated said main channel frequency domain signals with said auxiliary channel frequency domain signals according to said frequency subbands;

cancelling noise using successive combinations of weighted values of adjacent auxiliary channel subband data with associated main channel subband data, including a plurality of two-input Gram-Schmidt cancellers connected in cascade fashion;

calculating equivalent linear weights;

determining a weight matrix using said equivalent linear weights;

converting said signals from a frequency domain to a time domain using a plurality of Inverse Fast Fourier Transform elements, each said Inverse Fast Fourier Transform elements corresponding to a signal channel;

rotating weighted values of said weight matrix; and combining the resultant rotated weight values with time domain main channel and auxiliary channel data using a transversal filter network, thereby determining a main channel signal residue having noise cancellation.

* * * * *